United States Patent [19]

Iwakura et al.

[11] Patent Number: 4,471,074

[45] Date of Patent: Sep. 11, 1984

[54] HEAT-SENSITIVE RECORDING MATERIALS

[75] Inventors: Ken Iwakura; Masato Satomura; Sadao Ishige, all of Kanagawa, Japan

[73] Assignee: Fuji Photo Film Co., Ltd., Kanagawa, Japan

[21] Appl. No.: 442,812

[22] Filed: Nov. 18, 1982

[30] Foreign Application Priority Data

Nov. 18, 1981 [JP] Japan ..... 56-184907

[51] Int. Cl.[3] ..... B41M 5/18

[52] U.S. Cl. ..... 346/208; 346/209; 346/216

[58] Field of Search ..... 282/27.5; 427/150, 151; 428/320.8, 411, 488, 537, 913, 914

[56] References Cited

FOREIGN PATENT DOCUMENTS 55-9834 1/1980 Japan ..... 346/200

57-203591 12/1982 Japan ..... 503/216

*Primary Examiner*—Bruce H. Hess

*Attorney, Agent, or Firm*—Sughrue, Mion, Zinn, Macpeak & Seas

[57] ABSTRACT

A heat-sensitive recording material is disclosed. The material is comprised of an electron donating colorless dye and electron accepting compound in combination with naphthol derivative. The inclusion of the naphthol derivative as disclosed by applicants results in producing increased color density and sensitivity. Furthermore, the resulting material does not suffer from increased fogging and produces a color image which has sufficient fastness.

3 Claims, No Drawings

HEAT-SENSITIVE RECORDING MATERIALS

FIELD OF THE INVENTION

The present invention relates to heat-sensitive recording materials and particularly to heat-sensitive recording materials having improved color developing properties.

BACKGROUND OF THE INVENTION

Heat-sensitive recording materials comprising an electron donating colorless dye (color former) and an electron accepting compound (color developer) have been disclosed in Japanese Patent Publications Nos. 14039/70 (corresponding to U.S. Pat. No. 3,539,375) and 4160/68 (corresponding to U.S. Patent Application Ser. No. 512,546). Such heat-sensitive recording materials must have at least the following characteristics: (1) the color density and the color sensitivity must be sufficiently high, (2) fogging (coloration during preservation before using) is not caused and (3) the colors developed have sufficient fastness. However, present recording materials do not completely satisfy these requirements.

Recently, studies concerning the above described requirement (1) have been carried out due to recently developed high speed heat-sensitive recording systems.

In order to meet requirement (1) one approach has been to elevate the melting point of the electron accepting compound from 60° C. to 100° C. However, in phenolic compounds which have been widely used at present as the electron accepting compounds, it is difficult to control the melting point. Further, the phenolic compounds have little practical value, because they are expensive.

Other approaches have been described in Japanese Patent Publications Nos. 17748/74 and 39567/76. These approaches involve the use of a combination of an organic acid and a phenolic compound as an electron accepting material or the use of polyvalent metal salts of compounds having an alcoholic hydroxy group. Further, it has been described in Japanese Patent Publication No. 29945/76 to use hydroxyethyl cellulose and a copolymer of maleic acid anhydride slat.

Further, the addition of waxes has been described in Japanese Patent Publication No. 27599/76 and Japanese Patent Application (OPI) No. 19231/73 (The term "OPI" as used herein refers to a "published unexamined Japanese patent application".).

Additional approaches have been described in Japanese Patent Applications (OPI) Nos. 34842/74, 115554/74, 149353/75, 106746/77, 5636/78, 11036/78, 48751/78 and 72996/81. The approaches involve adding nitrogen containing organic compounds such as thioacetanilide, phthalonitrile, acetamide, di-β-naphthyl-p-phenylenediamine, aliphatic acid amide, acetoacetanilide, diphenylamine, benzamide or carbazole, etc., thermoplastic substances such as 2,3-m-tolylbutane or 4,4'-dimethyl-biphenyl, etc. or carboxylic acid esters such as dimethyl isophthalate, diphenyl phthalate or dimethyl terephthalate, etc. as a sensitizer.

However, the heat-sensitive recording materials produced by the above-described techniques are insufficient with respect to color density and the color sensitivity.

SUMMARY OF THE INVENTION

Accordingly, an object of the present invention is to provide heat-sensitive recording materials which have a sufficient color density and color sensitivity.

The objects of the present invention have been attained by providing heat-sensitive recording materials comprising an electron donating colorless dye, an electron accepting compound and a naphthol derivative.

DETAILED DESCRIPTION OF THE INVENTION

Among the naphthol derivatives used in the present invention, examples of preferred compounds are those represented by the following general formula (I):

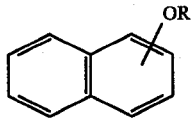

(I)

wherein R represents an alkyl group, an aralkyl group, an aryl group, an alkylcarbonyl group, an arylcarbonyl group, an alkyl sulfonyl group or an arylsulfonyl group.

In the above-described general formula, the naphthalene ring may have other substituents. Examples of such substituents include alkyl groups, aralkyl groups, halogen atoms, hydroxyl group, alkoxy groups, aralkyl groups, aryloxy groups, alkylcarbonyloxy groups, arylcarbonyloxy groups, alkoxycarbonyl groups, aryloxycarbonyl groups, carbamoyl groups and sulfamoyl groups, etc.

The substituent represented by R in the above-described general formula may have substituents.

Among substituents represented by R in the above-described general formula (I), preferable examples include alkyl groups having 4 to 20 carbon atoms, more preferably 4 to 12 carbon atoms, aralkyl groups having 7 to 24 carbon atoms, more preferably 7 to 12 carbon atoms, alkylcarbonyl groups having 2 to 20 carbon atoms, more preferably 4 to 14 carbon atoms, and arylcarbonyl groups having 7 to 20 carbon atoms, more preferably 7 to 12 carbon atoms.

Among substituents on the naphthalene ring in the above-described general formula (I), preferable examples include halogen atoms, alkyl groups having 1 to 10 carbon atoms, alkyloxycarbonyl groups having 2 to 20 carbon atoms, aryloxycarbonyl groups having 7 to 20 carbon atoms and substituted carbamoyl groups having 2 to 25 carbon atoms.

Among the above-described naphthol derivatives, those having a melting point of about 40° C. to about 150° C. are preferred and those having a melting point of 50° C. to 120° C. are particularly preferred.

The heat-sensitive recording materials containing the naphthol derivative represented by the general formula (I) according to the present invention yield a sufficient color density and have a sufficient color sensitivity. The materials also undergo less deterioration with the passage of time. Further, they cause a lesser degree of fogging, and the fastness of the developed material after development is sufficient.

In the following examples of naphthol derivatives according to the present invention are described, but the present invention is not limited to them.

(1) 1-Benzyloxynaphthalene (2) 2-Benzyloxynaphthalene (3) 2-p-Chlorobenzyloxynaphthalene
(4) 2-p-Isopropylbenzyloxynaphthalene
(5) 2-Dodecyloxynaphthalene
(6) 2-Decanoyloxynaphthalene
(7) 2-Myristoyloxynaphthalene
(8) 2-p-t-Butylbenzoyloxynaphthalene
(9) 2-Benzoyloxynaphthalene
(10) 2-Benzyloxy-3-N-(3-dodecyloxypropyl)carbamoylnaphthalene
(11) 2-Benzyloxy-3-N-octylcarbamoylnaphthalene
(12) 2-Benzyloxy-3-dodecyloxycarbonylnaphthalene
(13) 2-Benzyloxy-3-p-t-butylphenoxycarbonylnaphthalene
(14) 2-Octyloxynaphthalene Examples of the electron donating colorless dyes used in the present invention include triarylmethane compounds, diphenylmethane compounds, xanthene compounds, thiazine compounds and spiropyran compounds. Triarylmethane compounds and xanthene compounds are more preferred.

Examples of triarylmethane compounds include 3,3-bis-(p-dimethylaminophenyl)-6-methylaminophthalide (i.e. Crystal Violet lactone), 3,3-bis-(p-dimethylaminophenyl)-phthalide, 3-(p-dimethylaminophenyl)-3-(1,3-dimethylindol-3-yl)phthalide and 3-(p-dimethylaminophenyl)-3-(2-methylindol-3-yl)phthalide.

Examples of diphenylmethane compounds include 4,4'-bis-dimethylaminobenzohydrin benzyl ether, N-halophenyl leuco Auramine and N-2,4,5-trichlorophenyl leuco Auramine.

Examples of xanthene compounds include Rhodamine B anilinolactam, Rhodamine (p-nitroanilino)lactam, Rhodamine B (p-chloroanilino)lactam, 2-dibenzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-o-chloroanilino-6-diethylaminofluoran, 2-m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro- 6-diethylaminofluoran, 2-ethoxyethylamino-3-chloro-6-diethylaminofluoran, 2-anilino- 3-chloro-6-diethylaminofluoran, 2-diphenylamino-6-diethylaminofluoran, 2-anilino-3-methyl-6-diphenylaminofluoran and 2-phenyl-6-diethylaminofluoran.

Examples of thiazine compounds include benzoyl leuco Methylene Blue and p-nitrobenzyl leuco Methylene Blue.

Examples of spiropyran compounds include 3-methylspiro-dinaphthopyran, 3-ethyl-spiro-dinaphthopyran, 3,3'-dichloro-spiro-dinaphthopyran, 3-benzylspiro-dinaphthopyran, 3-methyl-naphtho-(3-methoxybenzo)spiropyran and 3-propylspiro-dibenzopyran.

Any of the above referred to compounds may be used alone or in combination with one another.

Examples of the electron accepting compounds include phenol compounds, organic acids and metal salts thereof, and oxybenzoic acid esters. Particularly, phenol compounds are preferably used, because they have a melting point near the desired recording temperature. Therefore, a compound having a low melting point is not required or may be used in a smaller amount. Such compounds are described in detail in, for example, Japanese Patent Publications Nos. 14039/70 and 29830/76, and U.S. Pat. Nos. 3,244,549 and 3,244,550. Examples of them include 4-tertiary butylphenol, 4-phenylphenol, 4-hydroxydiphenoxide, α-naphthol, β-naphthol, methyl 4-hydroxybenzoate, 2,2°-dihydroxybiphenyl, 2,2-bis-(4-hydroxyphenyl)propane(bisphenol A), 4,4'-isopropylidenebis-(2-methylphenol), 1,1-bis-(3-chloro-4-hydroxyphenyl)cyclohexane, 1,1-bis-(3-chloro-4-hydroxyphenyl)-2-ethylbutane and 4,4'-secondary-isobutylidenediphenol. Of the examples, 2,2-bis-(4-hydroxyphenyl)propane(bisphenol A) is most preferred.

The heat-sensitive recording materials of the present invention contain one kind of naphthol derivative, or if required, more kinds of the naphthol derivatives represented by the above-described general formula (I). In the following, embodiments of the process for producing them are described.

The most general process for producing the heat-sensitive recording materials will be described first. The above-described electron donating colorless dye and the electron accepting compound were dispersed, respectively, in a 1 to 10 wt. %, preferably 2 to 8 wt. %, aqueous solution of high polymer by means such as a ball mill or a sand mill. Preferred examples of high polymer include a polyvinyl alcohol (PVA), a methylcellulose, a hydroxyethylcellulose, an acryl amide series copolymer and a latex. Of the above high polymers, the polyvinyl alcohol is most preferably used. The molecular weight of the polyvinyl alcohol ranges from 1,000 to 20,000, preferably 1,500 to 10,000. After the blending was completed the inorganic pigments such as kaolin, talc or calcium carbonate were added to produce a coating solution. If necessary, materials such as paraffin wax emulsions, latex binders, sensitizers, metal soaps and ultraviolet ray absorbers may be added to the coating solution.

Generally, the coating solution is applied to a paper base.

The coating amount is generally 2 to 10 g/m$^2$, preferably 4 to 8 g/m$^2$, as a solid content. The lower limit depends upon the color density when heated, and the upper limit depends chiefly upon economic restriction.

The amount of the naphthol derivative used in the present invention is 0.1 to 4.0 g/m$^2$, preferably 0.2 to 2.0 g/m$^2$, and more preferably 0.3 to 1.5 g/m$^2$. The electron donating colorless dye is used in an amount of 0.1 to 2.0 g/m$^2$, preferably 0.2 to 1.0 g/m$^2$ and the electron accepting compound is used in an amount of 0.1 to 4.0 g/m$^2$, preferably 0.5 to 2.0 g/m$^2$.

The following is a detailed description of a specific example which was prepared. However, the present invention is not limited to this example.

EXAMPLE

(1) Production of Samples 1 to 8

5 g of the electron donating colorless dye shown in Table 1 was dispersed in 50 g of a 5% aqueous solution of polyvinyl alcohol (saponification value: 99%; degree of polymerization: 1000) by means of a ball mill for about 24 hrs. On the other hand, 20 g of the electron accepting compound (phenols) shown in Table 1 was dispersed similarly in 200 g of a 5% aqueous solution of polyvinyl alcohol by means of a ball mill for about 24 hrs. Further, 20 g of the naphthol derivative shown in Table 1 was dispersed in a 5% aqueous solution of polyvinyl alcohol by means of a ball mill for about 24 hrs. After these three dispersions were blended, 20 g of kaolin (Georgia Kaolin) was added thereto and dispersed therein. Further, 5 g of a 50% paraffin wax emulsion (Chukyo Yushi Cellosol #428) was added thereto to produce a coating solution.

The coating solution was applied to a paper base having an areal weight of 50 g/m$^2$ so as to result in a solid coating amount of 6 g/m$^2$. After the coating was dried at 60° C. for 1 minute, it was treated with a supercalendar at a linear pressure of 60 kg W/cm to obtain a coated paper.

The coated paper was thermally developed at a heat energy of 35 mJ/mm$^2$ by means of a facsimile receiving set (Type EF-22, made by Matsushita Denso Co. Ltd.), and the color density was determined.

The results are shown in Table 1.

(2) Production of Comparative Samples 1 to 2

The same examination was carried out using the same composition as in Samples 1 to 8, except that the compound shown in Table 1 was used instead of the naphthol derivative (no naphthol derivative of any kind was used in Comparative Samples 1 and 2).

The results are shown in Table 1.

It can be understood from Table 1 that the recording materials of the present invention have relatively high sensitivity.

Further, when the fog density in Table 1 exceeds 0.13, the commercial value deteriorates remarkably.

It is obvious from this viewpoint, too, that the heat-sensitive recording materials of the present invention are excellent.

It clearly appears as though the inclusion of a naphthol derivative in making a coating for a heat-sensitive material makes it possible to achieve the objects of the present invention.

The above results clearly show that greater color density can be obtained when a naphthol derivative of the invention is used. Furthermore, the results also show the increased color density is not accompanied by an undesirable increase in fog density.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material, comprising a base coated with a composition comprising:

an electron donating colorless dye;

an electron accepting compound; and a naphthol derivative represented by the general formula (I)

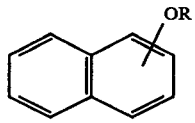

(I)

wherein R is an alkyl grouup, an aralkyl group, an aryl group, an alkylcarbonyl group, an arylcarbonyl group, alkyl sulfonyl group or an arylsulfonyl group.

2. A heat-sensitive recording material, as claimed in any of claim 1, wherein the naphthol derivative has a melting point of about 40° C. to about 150° C.

3. A heat-sensitive recording material, as claimed in claim 2, wherein the naphthol derivative has a melting point of 50° C. to 120° C.

* * * * *

TABLE 1

| Sample No. | Electron Donating Colorless Dye | Electron Accepting Compound | Naphthol Derivative | Color Density (35 mJ/mm$^2$) | Fog Density |
|---|---|---|---|---|---|
| 1 (This Invention) | 2-Anilino-3-chloro-6-diethylaminofluoran | 2,2-Bix-(4-hydroxyphenyl)propane | 1-Benzyloxynaphthalene | 1.00 | 0.07 |
| 2 (This Invention) | 2-Anilino-3-chloro-6-diethylaminofluoran | 2,2-Bix-(4-hydroxyphenyl)propane | 2-Benzyloxynaphthalene | 1.08 | 0.05 |
| 3 (This Invention) | 2-Anilino-3-methyl-6-diethylaminofluoran | 2,2-Bix-(4-hydroxyphenyl)propane | 2-Benzyloxynaphthalene | 1.07 | 0.06 |
| 4 (This Invention) | 2-Anilino-3-chloro-6-diethylaminofluoran | 1,1-Bis-(4-hydroxyphenyl)-2-ethylhexane | 2-Myristoyloxynaphthalene | 1.03 | 0.06 |
| 5 (This Invention) | 2-Anilino-3-chloro-6-diethylaminofluoran | 1,1-Bis-(4-hydroxyphenyl)-2-ethylhexane | 2-Benzoyloxynaphthalene | 1.03 | 0.06 |
| 6 (This Invention) | 2-Anilino-3-chloro-6-diethylaminofluoran | 2,2-Bis-(4-hydroxyphenyl)propane | 2-Benzyloxy-3-N—(3-dodecyloxypropyl)-carbamoylnaphthalene | 1.00 | 0.05 |
| 7 (This Invention) | 2-Anilino-3-chloro-6-diethylaminofluoran | 1,1-Bis-(4-hydroxyphenyl)-2-ethylhexane | 2-Benzyloxy-3-p-t-butylphenoxycarbonylnaphthalene | 1.02 | 0.06 |
| 8 (This Invention) | 2-Anilino-3-chloro-6-diethylaminofluoran | 2,2-Bis-(4-hydroxyphenyl)propane | 2-Octyloxynaphthalene | 1.05 | 0.06 |
| Comparative Example 1 | 2-Anilino-3-chloro-6-diethylaminofluoran | 2,2-Bix-(4-hydroxy phenyl)propane | Stearic acid amide | 0.52 | 0.06 |
| Comparative Example 2 | 2-Anilino-3-chloro-6-diethylaminofluoran | 2,2-Bix-(4-hydroxy phenyl)propane | — | 0.37 | 0.05 |